US007093621B2

(12) United States Patent
Canon et al.

(10) Patent No.: US 7,093,621 B2
(45) Date of Patent: Aug. 22, 2006

(54) MULTI-PIN PIN SEAM FOR AN INDUSTRIAL FABRIC

(75) Inventors: Luc Canon, Saint-Brice sur Vienne (FR); Jean-Louis Monnerie, St. Junien (FR)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 11/012,530

(22) Filed: Dec. 15, 2004

(65) Prior Publication Data

US 2006/0124192 A1 Jun. 15, 2006

(51) Int. Cl.
*D21F 7/08* (2006.01)

(52) U.S. Cl. ..... 139/383 A; 139/383 AA; 162/358.2

(58) Field of Classification Search ..... 139/383 A, 139/383 AA; 162/358.1, 358.2, DIG. 1, 162/904
See application file for complete search history.

(56) References Cited

U.S. PATENT DOCUMENTS

| | | | | |
|---|---|---|---|---|
| 3,900,659 | A * | 8/1975 | MacBean | 428/223 |
| 4,418,726 | A * | 12/1983 | Josef et al. | 139/383 AA |
| 4,658,863 | A * | 4/1987 | Errecart | 139/383 AA |
| 4,846,231 | A * | 7/1989 | Penven | 139/383 AA |
| 4,883,096 | A * | 11/1989 | Penven | 139/383 A |
| 4,887,648 | A * | 12/1989 | Cunnane | 139/383 AA |
| 4,896,702 | A * | 1/1990 | Crook | 139/383 A |
| 5,503,196 | A | 4/1996 | Josef et al. | |
| 5,601,120 | A | 2/1997 | Kuckart et al. | |
| 5,769,131 | A | 6/1998 | Whitlock et al. | |
| 5,789,052 | A * | 8/1998 | Miller et al. | 428/57 |
| 5,875,822 | A * | 3/1999 | Fargeout | 139/383 AA |
| 5,904,187 | A * | 5/1999 | Davenport | 139/383 AA |
| 6,194,331 | B1 * | 2/2001 | Elkins | 442/225 |
| 6,213,164 | B1 | 4/2001 | Ostermayer et al. | |
| 6,450,213 | B1 | 9/2002 | Gauthier et al. | |
| 6,508,278 | B1 | 1/2003 | Kornett | |

FOREIGN PATENT DOCUMENTS

| | | |
|---|---|---|
| EP | 0 341 043 A | 11/1989 |
| EP | 0 674 041 A | 9/1995 |
| WO | WO 01/61105 A | 8/2001 |

* cited by examiner

*Primary Examiner*—John J. Calvert
*Assistant Examiner*—Robert H. Muromoto
(74) *Attorney, Agent, or Firm*—Frommer Lawrence & Haug LLP; Ronald R. Santucci

(57) ABSTRACT

The present invention relates to a multi-pin pin seam used to join the a woven fabric wherein the loops are made around three or more cross-machine CD pins or pintles. Advantageously, this arrangement results in the seam area having a weave pattern that more closely conforms to that of the fabric body, and thus the risk of sheet marking and/or fabric abrasion in the seam area is reduced or eliminated.

15 Claims, 4 Drawing Sheets

MULTI-PIN PIN SEAM FOR AN INDUSTRIAL FABRIC

BACKGROUND OF THE INVENTION

1. Field of the Invention

The present invention relates to industrial fabrics. More particularly, the invention relates to a multi-pin seam for a woven fabric wherein the weave pattern in the seam area more closely conforms to that in the weave pattern in the fabric body.

2. Description of the Related Art

The production of nonwoven fabrics is well known in the art. Such fabrics are produced directly from fibers without conventional spinning, weaving or knitting operations. Instead, they may be produced by spun-bonding or melt-blowing processes in which newly extruded fibers are laid down to form a web while still in a hot, tacky condition following extrusion, whereby they adhere to one another to yield an integral nonwoven web.

Nonwoven product may also be produced by air-laying or carding operations where the web of fibers is consolidated, subsequent to deposition, into a nonwoven product by needling or hydroentanglement. In the latter, high-pressure water jets are directed vertically down onto the web to entangle the fibers with each other. In needling, the entanglement is achieved mechanically through the use of a reciprocating bed of barbed needles which force fibers on the surface of the web further thereinto during the entry stroke of the needles.

Endless industrial fabrics play a key role in these processes. Generally, these fabrics are woven from plastic monofilament, although metal wire may be used instead of plastic monofilament when, for example, temperature conditions during a nonwovens manufacturing process make it impractical or impossible to use plastic monofilament. As is the case with other industrial fabrics like paper machine clothing, such industrial fabrics also function in the manner of conveyors on which the webs are laid down and consolidated in a continuous fashion according to the methods described above.

It should be recalled that, at one time, industrial fabrics, particularly ones used in the production of nonwovens and certain aspects of papermaking, were supplied only in endless form. This is because the fibrous web being produced is extremely susceptible to defects such as marking by any nonuniformity in the fabric or fabrics. An endless, seamless fabric, such as one produced by the process known as endless weaving, has a uniform structure in both its longitudinal (machine) and transverse (cross-machine) directions. A seam, such as a seam which may be used to close the fabric into endless form during installation on a machine, represents a discontinuity in the uniform structure of the fabric. The use of a seam, then, greatly increases the likelihood that the cellulosic or synthetic fibrous web will be marked for example.

Furthermore, some industrial machine producing products such as nonwovens have solid frames. This means that either a significant portion of the machine is taken apart or dismantled or both to install an endless fabric; or what was required was to develop fabric that had seams that could be installed and made endless by closing the seam. Early prior art fabrics had seams of various types, all of which formed a noticeable discontinuity in the fabric.

Several varieties of industrial fabrics are designed to be closed into endless form during installation of production machines. For example, papermaker's dryer fabrics may be joined into the form of an endless loop during installation in a dryer section of a paper producing machine. Dryer fabrics may be so joined with a pin seam. Other industrial fabrics, such as the aforenoted fabrics for the manufacture of nonwovens, in addition to corrugator belts, pulp-forming fabrics and sludge-dewatering fabrics and DNT dewatering fabrics, are seamed in a similar fashion.

For this reason, the seam region of any workable on-machine-seamable fabric must behave as best it can, like the rest of the fabric, in order to prevent the periodic marking of the product being manufactured by the seam region of the fabric.

Despite the considerable technical obstacles presented by these requirements, it remained highly desirable to develop an improved on-machine-seamable fabric. Ultimately, these obstacles were overcome with the development of fabrics having seams formed by providing seaming loops on the crosswise edges of the two ends of the fabric. The seaming loops themselves may be formed by the machine-direction (MD) yarns of the fabric. The seam is closed by bringing the two ends of the fabric together, by interdigitating the seaming loops at the two ends of the fabric, and by directing a so-called pin, or pintle, through the passage defined by the interdigitated seaming loops to lock the two ends of the fabric together. Needless to say, it is much easier and far less time-consuming to install an on-machine-seamable fabric, than it is to install an endless fabric, on a machine.

One method to produce a fabric that can be joined on a machine with such a seam is to flat-weave the fabric. In this case, the warp yarns are the machine-direction (MD) yarns of the fabric. To form the seaming loops, the warp yarns at the ends of the fabric are turned back and woven some distance back into the fabric body in a direction parallel to the warp yarns.

In certain instances multi-pin or pintle seams may be desired. In this regard FIG. 1B (plan view), FIG. 2B, and FIGS. 3A and 3B (cross section) illustrate a prior art standard double pin seam on an asymmetrical single layer fabric 10. As seen in FIG. 1B, the fabric 10 comprises a plurality of rows of MD yarns 14 interwoven with a single layer of CD yarns 12. In the seam area, each MD yarn 14 form a seaming loop 16 around two joining pins or pintles 18. In this way, the double pin seam is used to join the two ends of the fabric 10. Each of FIGS. 3A and 3B show a cross section of this fabric 10 (the left and right fabric ends appear separated, and the two pins 18 appear twice, for clarity only) on the machine during installation. The pins are removed from the fabric ends with the loops interdigitated and the pins reinserted creating the seam and making the fabric endless. As can be seen, a first row of MD yarns 14 is formed, then a second row and so on with this sequence of first and second rows repeated over and over to form a full width fabric 10.

As illustrated in each of FIGS. 3A and 3B, the weave pattern in the fabric body (i.e., non-seam area) is such that the MD yarns 14 define long floats over the CD yarns 12 on the fabric face, and short knuckles on the back of the fabric 10. The weave pattern in the seam area, however, is different than that in the fabric body. In the seam area, the MD yarns 14 merely form loops 16 around the pins 18 at the fabric ends. This dissimilarity between the weave of the fabric body and that of the seam area results in a discontinuity on the fabric surface. This discontinuity is also shown in FIG. 2B (cross sectional view), and unfortunately, can lead to marking of a product carried on the fabric or abrasion of the seam area of the fabric by stationary elements 10 during use.

This discontinuity also exists in the case of a standard double pin seam on a symmetrical double layer fabric. FIGS. 4D and 4E show a cross section of the fabric ends joined using the two pins 18 (In FIG. 4E, the left and right fabric ends appear separated, and the two pins 18 appear twice, for clarity only). As can be seen, a first row of MD yarns 14 is formed, then a second row, and so on with this sequence of first and second rows repeated over and over to form a full width fabric 10.

As illustrated in each of FIGS. 4D and 4E, the weave in the fabric body is such that the MD yarns 14 define knuckles on both the fabric face and back. The weave pattern in the seam area, however, is different than that in the fabric body. In the seam area, the MD yarns 14 again merely form loops 16 around the pins 18 at the fabric ends. In some instances alternative rows of MD yarns 14 can form differing loop lengths and geometries resulting in dissimilarities between the seam and the body of the fabric. As mentioned above, this dissimilarity between the weave of the fabric body and that of the seam area results in a discontinuity on the fabric surface. As previously mentioned, this discontinuity can lead to marking of a product carried on the fabric or abrasion of the fabric seam itself by stationary objects.

In view of the foregoing, there exists a need for a seam having a weave pattern that conforms more closely to the weave pattern in the rest of the fabric.

SUMMARY OF THE INVENTION

Accordingly, the present invention relates to a multi-pin pin seam used to join a woven fabric wherein seaming loops are made around three or more pins or pintles. Advantageously, this arrangement results in the seam area having a weave pattern which more closely conforms to the fabric body, so as to reduce or minimize discontinuity and thus reduce or minimize marking of the product thereon with the risk of abrasion in the seam area reduced or eliminated.

In this regard, the fabric of the present invention comprises a plurality of cross-machine direction (CD) yarns woven with a plurality of machine direction (MD) yarns extending between two opposite ends of the fabric. The fabric ends are joined in a seam area by three or more pins or pintles disposed in the CD direction. Each MD yarn is looped around one or more of the CD pins or pintles at each end of the fabric in such a fashion so that the seam area conforms more closely to the weave pattern in the rest of the fabric.

The present invention will now be described in more complete detail with frequent reference being made to the drawings identified below.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE PREFERRED EMBODIMENTS

Figure 1A:
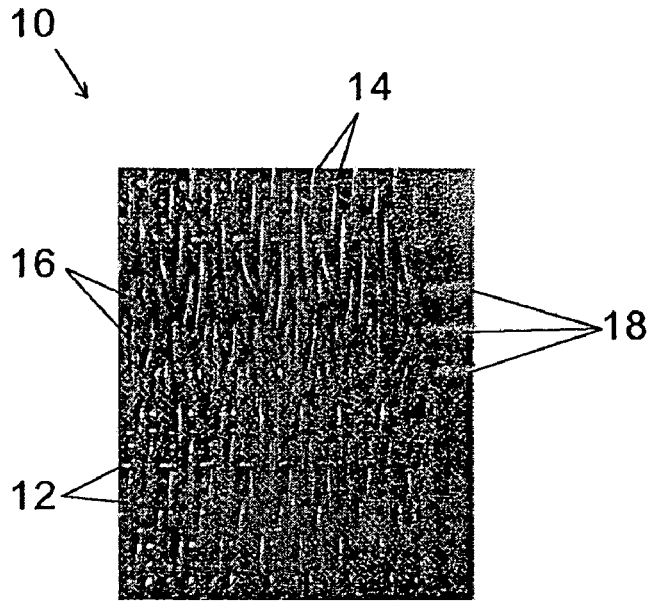
FIG. 1A is a plan view of a triple pin seam according to the present invention.
Figure 1B:
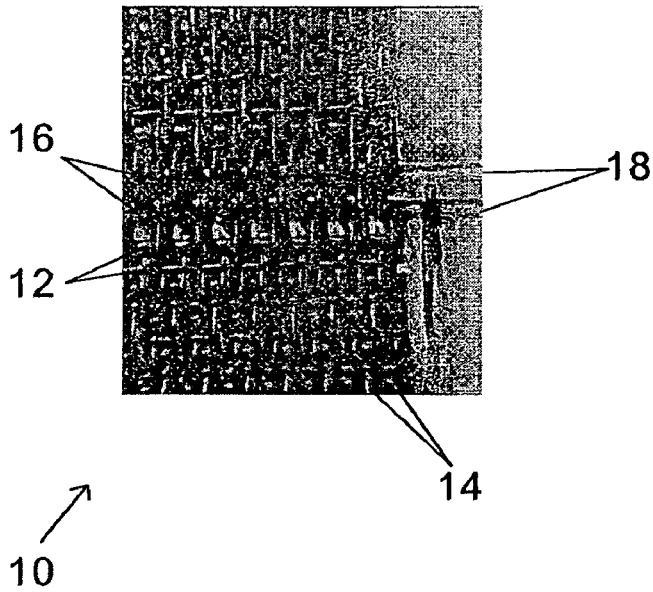
FIG. 1B (PRIOR ART)
FIG. 1B is a plan view of a prior art standard double pin seam.
Figure 2A:
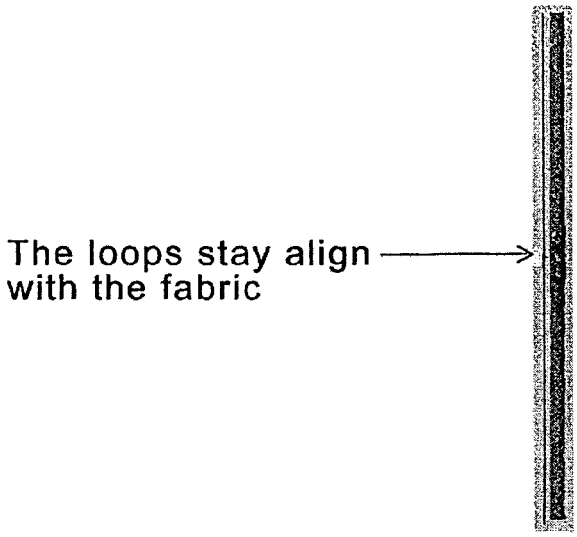
FIG. 2A is a cross-sectional view of the triple pin seam according to the present invention.
Figure 2B:
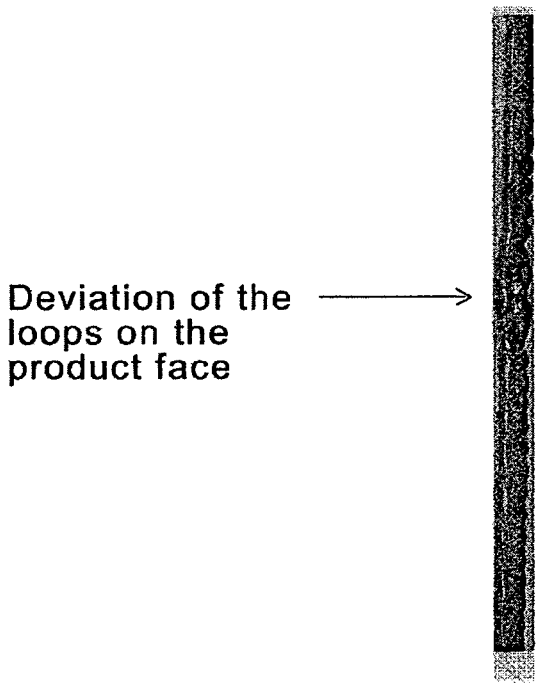
FIG. 2B (PRIOR ART)
FIG. 2B is a cross-sectional view of a prior art standard double pin seam.
Figure 3A:
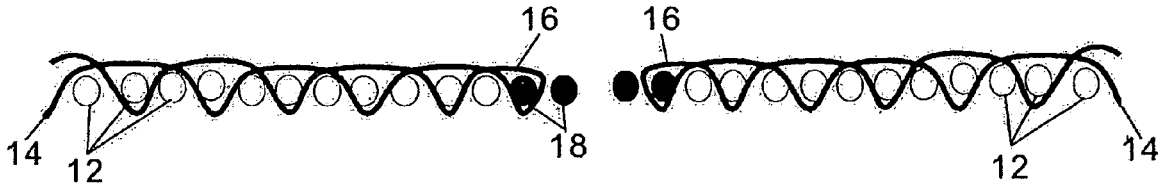
FIG. 3A (PRIOR ART)
FIGS. 3A and 3B are cross-sectional views of a prior art standard double pin seam on an asymmetrical single layer.
Figure 3B:
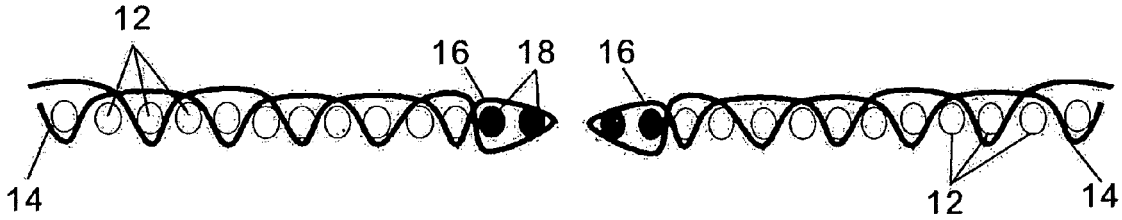
FIG. 3B (PRIOR ART)
Figure 3C:
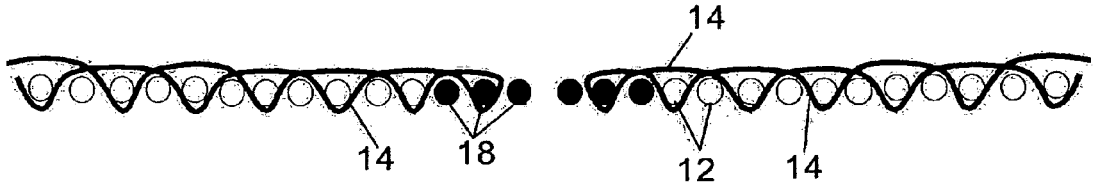
FIGS. 3C–3E are cross-sectional views of the triple pin seam on an asymmetrical single layer, according to the present invention.
Figure 3D:
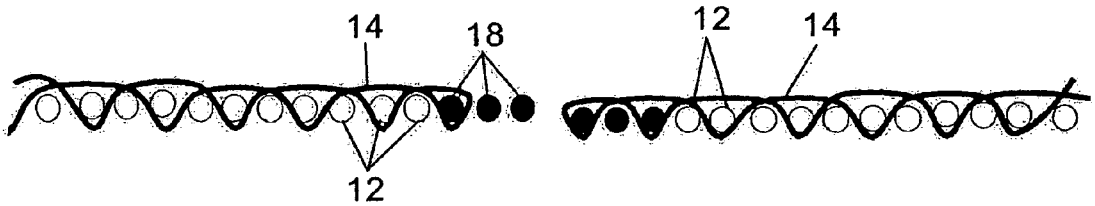
Figure 3E:
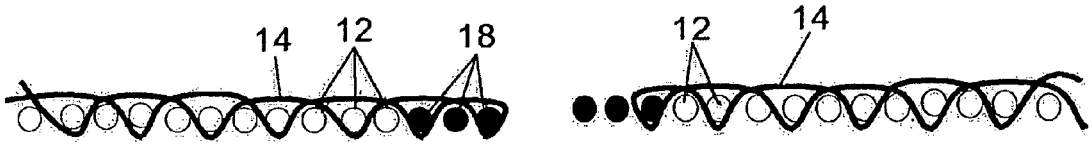

Referring now more specifically to the drawing figures, one embodiment of the invention is shown in FIG. 1A (plan view), FIG. 2A (cross section), and FIGS. 3C–3E (cross section). In general, the triple pin seam illustrated in these figures results in less of a discontinuity on the surface of the fabric 10, compared with the prior art double pin seam. This is clearly illustrated in a comparison of FIG. 2A to FIG. 2B, which show seaming loops that stay aligned in FIG. 2A and seaming loops that deviate from the fabric face in FIG. 2B. Accordingly in FIG. 2A the weave pattern in the seam area conforms more closely to that in the rest of the fabric 10 than that practiced in the prior art. Consequently, marking of a product transported on the fabric 10 and abrasion to the fabric in the seam area as it passes over stationary elements when in use, is reduced or eliminated.

As seen in FIG. 1A, the fabric 10 according to the invention comprises a plurality of rows of MD yarns 14 interwoven with a single layer of CD yarns 12. In the seam area, each MD yarn 14 forms a seaming loop 16 around one or more of the three CD pins or pintles, 18. In this way, the triple pin seam is used to join the two ends of the fabric 10. This fabric 10 is shown cross-sectionally in each of FIGS. 3C, 3D and 3E (the left and right fabric ends appear separated, and the three pins 18 appear twice, for clarity only). Seen in FIGS. 3C–3D are first, second and third rows of MD yarns 14 interwoven with the layer of CD yarns 12. This sequence of first, second and third MD yarn rows is repeated over and over to form a full width fabric 10. Incidentally, the MD yarns 14, CD yarns 12, and CD pins or pintles 18 can be of circular cross section, although other cross sectional shapes such as noncircular are contemplated. In the present embodiment, the CD pins or pintles 18 are of substantially the same diameter as the CD yarns 12, but are not limited thereto and may be different depending upon the application. Also the pins or pintles may be made of the same material as the MD or CD yarns, such as an appropriate polymer, metal or other material suitable for the purpose or particular application, or may be different.

As illustrated in each of FIGS. 3C–3E, the weave pattern in the non-seam area, or fabric body, is such that the MD yarns 14 define long floats over the CD yarns 12 on the fabric face, and short knuckles on the back of the fabric 10. More specifically, the MD yarns 14 define floats covering three consecutive CD yarns 12. After each float over the fabric face, the MD yarn 14 passes through the CD plane to be woven around a single CD yarn 12 to define a short knuckle on the back face, and thereafter is woven to define another long float on the fabric face.

Advantageously, the weave pattern in the seam area more closely conforms to that in the fabric body. That is, in the seam area, the MD yarns 14 form long floats over consecutive CD yarns and pins 18 on the fabric face, and form short knuckles on the fabric back. As a result of this similarity or conformity between the weave in the fabric body and that of the seam area there is greater continuity on the face of the fabric 10, as compared with a prior art fabric having conventional pin seams. This conformity on the fabric face where the seaming loops in essence stay aligned with that of the fabric body is also evident in FIG. 2A (cross sectional view), and, as mentioned, lessens the risk of marking a product carried by the fabric or abrasion of the fabric in the seam area during use.

Figure 4A:
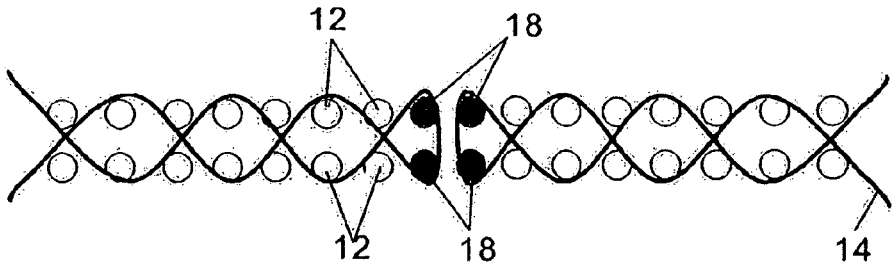
FIGS. 4A–4C are cross-sectional views of a four pin seam on a double layer symmetrical fabric, according to the present invention.
Figure 4B:
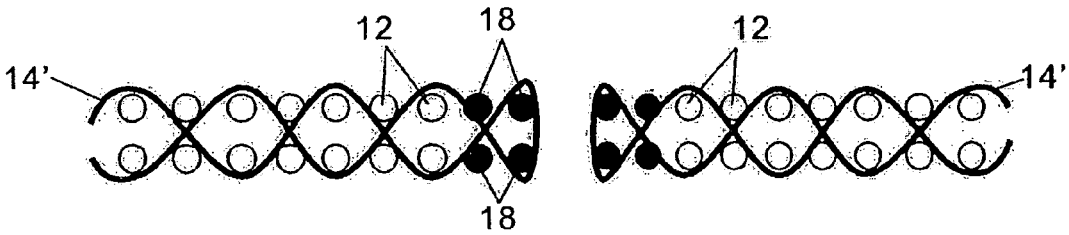
Figure 4C:
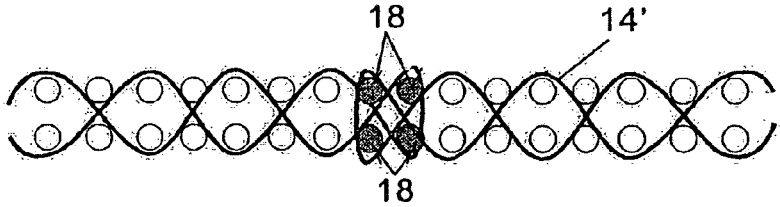
Figure 4D:
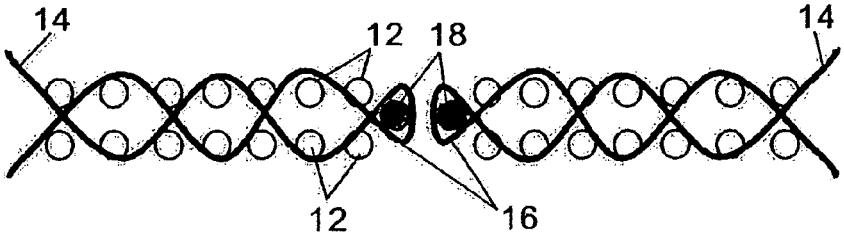
FIG. 4D (PRIOR ART)
FIGS. 4D and 4E are cross-sectional views of a prior art standard double pin seam on a double layer symmetrical fabric.
Figure 4E:
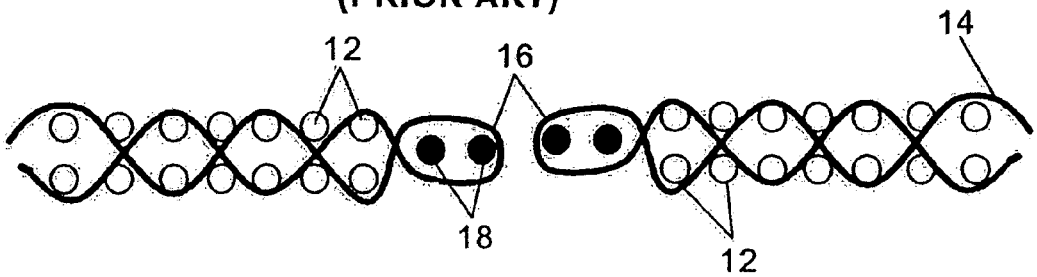
FIG. 4E (PRIOR ART)

This conformity on the fabric face is also provided in the case of a four-pin seam on a symmetrical double layer fabric 10, according to another embodiment of the present invention. Each of FIGS. 4A–4C show a cross section of this fabric 10 joined using the four pins 18 (In FIG. 4B, the left and right fabric ends appear separated, and the four pins 18 appear twice, for clarity only). Seen in FIGS. 4A–4C are a first row 14 and a second row 14 of MD yarns interwoven with the double layer of CD yarns 12. This sequence of first and second MD yarn rows is repeated over and over to form a full width fabric 10.

As illustrated in each of FIGS. 4A–4C, the weave in the fabric body is such that the MD yarns 14 define short knuckles on both the fabric face and fabric back. Thus, this weave pattern in the seam area more closely conforms to that in the fabric body. That is, in the seam area, the MD yarns 14 also define knuckles over the pins 18 on the fabric face and back face. As mentioned above, this conformity between the weave of the fabric body and that of the seam area reduces or eliminates product marking and/or fabric abrasion associated with conventional prior art double pin seams.

One skilled in the art will readily understand that the present invention is applicable to a wide variety of industrial fabrics including but not limited to fabrics for producing nonwovens, corrugator belts, pulp forming fabrics, sludge dewatering fabrics, DNT dewatering fabrics, in addition to other fabrics or belts which may used in papermaking production, particularly dryer fabrics.

Further, although preferred embodiments of the present invention and modifications thereof have been described in detail herein, it is to be understood that this invention is not limited to those precise embodiments and modifications, and that other modifications and variations may be effected by one skilled in the art without departing from the spirit and scope of the invention as defined by the appended claims.

What is claimed is:

1. A woven fabric comprising a fabric body having a weave pattern made from a plurality of cross-machine direction (CD) yarns, and plurality of machine direction (MD) yarns extending between two opposite ends of the fabric, the MD yarns being looped around three or more CD pins or pintles in a seam area, the woven fabric comprising:

a first row of MD yarns being looped around a first of said pintles adjacent to a third row of MD yarns from the opposite fabric end being looped around the first of said pintles, a second row of MD yarns being looped around a second of said pintles adjacent to a second row of MD yarns from the opposite fabric end being looped around the second of said pintles, a third row of MD yarns being looped around a third of said pintles adjacent to a first row of MD yarns from the opposite fabric end being looped around the third of said pintles, so as to create a seam such that a weave pattern in said seam area conforms more closely to that of the weave pattern in the fabric body.

2. The fabric of claim 1, comprising a single layer of CD yarns.

3. The fabric of claim 1, wherein the weave patterns is symmetrical or asymmetrical.

4. The fabric of claim 1, wherein the MD yarns define long floats on a fabric face and short knuckles on a back face or vice versa or one or the other or both.

5. The fabric of claim 1, wherein said fabric is an industrial fabric.

6. The fabric of claim 1, wherein the pintles are of a same diameter or different from the CD yarns.

7. The fabric of claim 1, wherein the MD and CD yarns are of circular cross section or noncircular cross section.

8. The fabric of claim 1, wherein loop deviation in the seam area from the fabric body is reduced.

9. A woven fabric comprising two layers of a plurality of cross-machine direction (CD) yarns, and a plurality of machine direction (MD) yarns extending between two opposite ends of the fabric to create the fabric body, the woven fabric comprising:

at least four pintles in a seam area, wherein a first and third of the pintles are disposed adjacently in a direction and plane of a first layer of CD yarns, and a second and fourth of the pintles are disposed adjacently in a direction and plane of a second layer of CD yarns, a first row of MD yarns, the MD yarns being looped around a first and second of said pintles at one fabric end, and said first row of MD yarn being looped around a third and fourth of said pintles at the other fabric end, and a second row of MD yarns adjacent to said first row, the second row of MD yarns being looped around the third and fourth pintles at the one fabric end, and the second row of MD yarns being looped around the first and second pintles at the other fabric end, so to create a seam such that a weave pattern in said seam area more closely conforms to a weave pattern of the fabric.

10. The fabric of claim 9, wherein the weave patterns are symmetrical.

11. The fabric of claim 9, wherein the MD yarns define long floats or short knuckles on a fabric face or a back face or on one or the other or both.

12. The fabric of claim 8, wherein said fabric is an industrial fabric.

13. The fabric of claim 9, wherein the pintles are of a same diameter or different diameter as the CD yarns.

14. The fabric of claim 9, wherein the MD and CD yarns are of circular or noncircular cross section.

15. The fabric of claim 9, wherein loop deviation in the seam area is reduced from the fabric body.

* * * * *

UNITED STATES PATENT AND TRADEMARK OFFICE

CERTIFICATE OF CORRECTION

PATENT NO. : 7,093,621 B2
APPLICATION NO. : 11/012530
DATED : August 22, 2006
INVENTOR(S) : Canon et al.

It is certified that error appears in the above-identified patent and that said Letters Patent is hereby corrected as shown below:

Column 6, Claim 12, please change from:

The fabric of claim 8, wherein said fabric is an industrial fabric.

to

The fabric of claim 9, wherein said fabric is an industrial fabric.

Signed and Sealed this

Twenty-ninth Day of April, 2008

JON W. DUDAS
*Director of the United States Patent and Trademark Office*

UNITED STATES PATENT AND TRADEMARK OFFICE

CERTIFICATE OF CORRECTION

PATENT NO. : 7,093,621 B2
APPLICATION NO. : 11/012530
DATED : August 22, 2006
INVENTOR(S) : Canon et al.

It is certified that error appears in the above-identified patent and that said Letters Patent is hereby corrected as shown below:

Column 6, Claim 12, lines 52 and 53, please change from:

The fabric of claim 8, wherein said fabric is an industrial fabric.

to

The fabric of claim 9, wherein said fabric is an industrial fabric.

This certificate supersedes the Certificate of Correction issued April 29, 2008.

Signed and Sealed this

Twentieth Day of May, 2008

JON W. DUDAS
*Director of the United States Patent and Trademark Office*